US006134720A

United States Patent [19]

Foreman

[11] Patent Number: 6,134,720

[45] Date of Patent: Oct. 24, 2000

[54] SHIN GUARD WITH ENHANCED TIBIAL PROTECTION

[75] Inventor: Louis J. Foreman, Huntersville, N.C.

[73] Assignee: Parker Athletic Products, LLC, Charlotte, N.C.

[21] Appl. No.: 09/363,416

[22] Filed: Jul. 29, 1999

[51] Int. Cl.[7] ..... A61F 5/00

[52] U.S. Cl. ..... 2/455; 2/22; 128/882; 602/6; 602/8

[58] Field of Search ..... 2/455, 16, 22, 2/267, 24, DIG. 3; 128/878, 881, 882, 846; 602/5, 6, 7, 8, 41, 60, 65

[56] References Cited

U.S. PATENT DOCUMENTS

| | | | |
|---|---|---|---|
| 223,049 | 12/1879 | Koehler | 602/5 |
| 2,940,884 | 6/1960 | White . | |
| 3,557,156 | 1/1971 | Enneper et al. . | |
| 3,900,024 | 8/1975 | Lauber et al. . | |
| 3,923,049 | 12/1975 | Lauber et al. . | |
| 4,067,063 | 1/1978 | Ettinger | 2/16 |
| 4,235,228 | 11/1980 | Gaylord, Jr. et al. . | |
| 4,279,344 | 7/1981 | Holloway, Jr. . | |
| 4,411,262 | 10/1983 | von Bonin et al. . | |
| 4,427,002 | 1/1984 | Baron et al. . | |
| 4,433,680 | 2/1984 | Yoon . | |
| 4,442,833 | 4/1984 | Dahlen et al. . | |
| 4,502,479 | 3/1985 | Garwood et al. . | |
| 4,570,622 | 2/1986 | von Bonin et al. . | |
| 4,572,171 | 2/1986 | Wegner et al. . | |
| 4,676,861 | 6/1987 | Bishop . | |
| 4,770,299 | 9/1988 | Parker . | |
| 4,869,046 | 9/1989 | Parker . | |
| 5,003,970 | 4/1991 | Parker et al. . | |
| 5,345,609 | 9/1994 | Fabry et al. | 2/20 |
| 5,356,371 | 10/1994 | Hubbard | 602/22 |
| 5,456,658 | 10/1995 | Duback et al. | 602/8 |
| 5,480,376 | 1/1996 | Duback et al. | 602/8 |
| 5,544,663 | 8/1996 | Duback . | |
| 5,551,084 | 9/1996 | Freese, III | 2/23 |
| 5,637,077 | 6/1997 | Parker | 602/8 |
| 5,665,056 | 9/1997 | Nakasugi et al. | 602/8 |
| 5,732,713 | 3/1998 | Duback et al. | 128/846 |
| 5,755,678 | 5/1998 | Parker et al. | 602/6 |
| 5,957,871 | 9/1999 | Darcey | 602/12 |
| 5,980,474 | 11/1999 | Darcey | 602/5 |
| 6,022,331 | 2/2000 | Darcey | 602/12 |

FOREIGN PATENT DOCUMENTS

| | | |
|---|---|---|
| 630022 | 10/1961 | Canada . |
| 2 200 286 | 8/1988 | United Kingdom . |

OTHER PUBLICATIONS

C–Splint Immobilizer (1982); Cutter Laboratories, Inc.

Scotchcast 2 Splinting System (Undated) (Orthopedic Products Division, Minnesota Mining & Manufacturing Company).

*Primary Examiner*—John J. Calvert
*Assistant Examiner*—Tejash Patel
*Attorney, Agent, or Firm*—Adams, Schwartz & Evans, P.A.

[57] ABSTRACT

An athletic body protective product such as a shin guard with enhanced protection against direct impact to bone structure shin. The guard includes a storage package formed of moisture-impervious material and sealable to prevent entry of moisture, a flexible protective guard positioned in the storage package and sealed therein against entry of moisture for being custom-formed to the shape of the shin while flexible and upon hardening providing a rigid, supporting custom fit. The guard includes a reactive system impregnated into or coated onto a substrate, the system remaining stable when maintained in substantially moisture-free conditions and hardening upon exposure to sufficient moisture to form a rigid, self supporting structure. A flexible pad is positioned on one side of the substrate along its length to provide a cushioning barrier between the hardened substrate and the protected bone of the athlete when the protective guard is in use. An elongate cover encloses the substrate on a side of the substrate opposite the protective pad, The substrate, protective pad and cover are joined together to form a unitary structure. An elongate, narrow, supplemental bone protection pad is positioned relative to the shape of the protective pad so as to reside in overlying relation to the shin bone for providing supplemental protection against direct impact.

18 Claims, 11 Drawing Sheets

SHIN GUARD WITH ENHANCED TIBIAL PROTECTION

TECHNICAL FIELD AND BACKGROUND OF THE INVENTION

This invention relates to a custom-fitted body protective guard, such as a shin guard, used to protect against injuries to sports participants, and to protect previous injuries from re-injury during continued play. The particular embodiment shown in the application is of a shin guard of the type to be used by soccer players during competition. The invention has application in any field—including non-sports related activities—which require or make desirable an accurate custom fit between the protective device and the body member. The invention takes advantage of polymer chemistry to permit quick and easy molding of a pad to the body part to be protected. Shock attenuation is increased since the custom fit provides greater contact between the protective device and the body member. The invention has particular application in protecting bones which lie directly beneath the skin from direct impact.

Prior art body protectors include numerous types of guards which are fitted over the body part, such as the shin. These devices typically include a soft component to place near the skin and a hard, shell-like outer cover. The soft component is intended not only to provide a cushion, but also to accommodate itself to the varying configurations of differing sized and shaped body parts. For this reason, the cushioned part is substantially greater in thickness than required merely to provide the required amount of shock attenuation. Such devices are sufficiently "generic" that in many instances they are required to be held in place by straps or bands.

Other prior art devices include pads which are constructed of thermosetting materials, which are heated and then formed to the body while heated. When cool, the pad retains the shape to which it was molded when heated. These products require a source of heat, and are susceptible to either over-or-underheating. In addition, body heat itself can soften or at least increase the flexibility of the pad, thereby decreasing the effectiveness of the protection offered by the pad. Some prior art pads include air bladders which provide an air cushion against injurious blows. Other prior art devices have a plurality of connected-together segments which are hinged for limited movement relative to each other, on the theory that such movement permits the pad to more closely conform to the body part. All of these prior art devices achieve only an approximation of a truly proper and anatomically correct fit. The moisture curable resin system used in the present invention results in a very rigid pad, which holds the shape of the molded pad to a very high degree. No heat is required, and only a source of water is necessary. Atmospheric moisture alone will cure the pad into its hardened position in a relatively short period of time.

The present invention permits quick and easy application of a protective pad to a body part in such a way as to achieve a true custom fit. In the embodiment disclosed in the application, an elongate protective pad provides enhances protection to the tibia.

The tibia is situated at the front and inner side of the lower leg below the knee, and except for the femur, is the longest and largest bone in the body. It is prismoid in form, and lies directly beneath the skin along the anterior aspect of the lower leg, commonly known as the "shin." The shaft of the tibia is generally triangular in cross-section, gradually decreasing in size to its most slender part in the lower fourth of its length. This most slender area is the very are where direct impact to the tibia during athletic competition such as soccer and baseball is most likely to occur. Fractures, severe bruising and laceration of the skin in this area of the tibia are commonplace during certain types of athletic competition. The lack of muscle and/or fat overlying the anterior border, or crest of the tibia, deprives the tibia of protection afforded other bones, which avoid breakage at the expense of bruising of the overlying flesh. Likewise, the fact that the tibia lies directly beneath the skin greatly increases the effective force applied to the skin from direct impact by depriving the skin of an underlying padding of fat and muscle to absorb and disperse blows.

The invention disclosed herein provides a very lightweight shin guard which nevertheless furnishes superior protection to the tibia and the overlying skin.

SUMMARY OF THE INVENTION

Therefore, it is an object of the invention to provide a body protective guard which can be molded to a body part to be protected.

It is another object of the invention to provide a body protective guard which hardens in the presence of moisture to form a very rigid but very lightweight protective structure.

It is another object of the invention to provide a body protective guard which provides enhanced protection to bones which lie close to the skin of the wearer, such as the tibia.

It is another object of the invention to provide a body protective guard which is suitable for protecting bones lying close to the skin against injury, and protecting injured bones against further damage.

It is another object of the invention to provide a body protective guard which can be worn without being held in place by straps or belts.

These and other objects of the present invention are achieved in the preferred embodiments disclosed below by providing an athletic body protective product with enhanced protection against direct impact to bone structure of the protected body part. The protective product includes a storage package formed of moisture-impervious material and sealable to prevent entry of moisture, a flexible protective guard positioned in the storage package and sealed therein against entry of moisture, and for being custom-formed to the shape of a body part to be protected while flexible and upon hardening providing a rigid, supporting custom fit to the body part. The protective guard comprises a substrate, including a reactive system impregnated into or coated onto the substrate, the system remaining stable when maintained in substantially moisture-free conditions and hardening upon exposure to sufficient moisture to form a rigid, self supporting structure. A flexible protective pad is positioned on one side of the substrate along its length to provide a cushioning barrier between the hardened substrate and the protected bone of the athlete when the protective guard is in use. An elongate cover encloses the substrate on a side of the substrate opposite the protective pad, and attachment means are provided for attaching together the substrate, protective pad and cover to form a unitary structure. An elongate, narrow, supplemental bone protection pad is positioned relative to the shape of the protective pad so as to reside in overlying relation to the bone to be protected for providing supplemental protection against direct impact to the protected bone.

Preferably, the guard includes a pocket formed in vertically-extending orientation along its length for receiving and retaining the supplemental pad.

According to one preferred embodiment of the invention, the supplemental pad includes a flexible, resilient compressible member.

According to another preferred embodiment of the invention, the supplemental pad includes a flexible, resilient compressible member contained within a protective envelope.

According to yet another preferred embodiment of the invention, the supplemental pad comprises an elongate protective gas impermeable envelope, the interior of which contains a gas sealed therein under positive pressure to form a pneumatic cushion.

According to yet another preferred embodiment of the invention, the supplemental pad comprises an elongate protective gas impermeable envelope, the interior of which contains a gas sealed therein under positive pressure to form a pneumatic cushion; and an elongate, flexible, resilient compressible member enclosed within the envelope to provide a mechanical cushion, whereby the supplemental pad provides a combination of pneumatic and mechanical protection against direct impact to the protected bone.

According to yet another preferred embodiment of the invention, the supplemental pad is no more than one-third the width of the guard at the narrowest point along its length.

According to yet another preferred embodiment of the invention, the substrate comprises a plurality of overlaid fabric sheets, such as fiberglass.

According to yet another preferred embodiment of the invention a shin guard product with enhanced tibial protection is provided, and comprising a storage package formed of moisture-impervious material and sealable to prevent entry of moisture, a flexible shin guard positioned in the storage package and sealed therein against entry of moisture for being custom-formed to the shape of a shin while flexible and upon hardening providing a rigid, supporting custom fit to the shin. The shin guard comprises a substrate, including a reactive system impregnated into or coated onto the substrate, the system remaining stable when maintained in substantially moisture-free conditions and hardening upon exposure to sufficient moisture to form a rigid, self supporting structure. A flexible protective pad is positioned on one side of the substrate along its length to provide a cushioning barrier between the hardened substrate and the shin of the athlete when the shin guard is in use. An elongate cover encloses the substrate on a side of the substrate opposite the protective pad. Attachment means are provided for attaching together the substrate, protective pad and cover to form a unitary structure. An elongate, narrow, supplemental shin protection pad is positioned in vertically-extending orientation along the length of the substrate in overlying relation to the shin bone of the wearer for providing supplemental protection against direct impact to the shin bone portion of the lower leg.

According to yet another preferred embodiment of the invention, a pocket is formed in vertically-extending orientation along the length of the shin guard for receiving and retaining the supplemental pad.

According to another preferred embodiment of the invention, the supplemental pad includes a flexible, resilient compressible member.

According to yet another preferred embodiment of the invention, the supplemental pad includes a flexible, resilient compressible member contained within a protective envelope.

According to yet another preferred embodiment of the invention, the supplemental pad comprises an elongate protective gas impermeable envelope, the interior of which contains a gas sealed therein under positive pressure to form a pneumatic cushion.

According to yet another preferred embodiment of the invention, the supplemental pad comprises an elongate protective envelope, the interior of which contains a gas sealed therein under positive pressure to form a pneumatic cushion; and an elongate, flexible, resilient compressible member enclosed within the envelope to provide a mechanical cushion, whereby the supplemental pad provides a combination of pneumatic and mechanical protection against direct impact to the shin bone.

According to yet another preferred embodiment of the invention, the supplemental pad is no more than one-third the width of the shin guard at its narrowest point along its length.

According to yet another preferred embodiment of the invention, the supplemental pad is laterally offset with respect to the vertical centerline of the pad so as to reside directly over the crest of the tibia.

According to yet another preferred embodiment of the invention, the resilient compressible member comprises a dense foam material.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
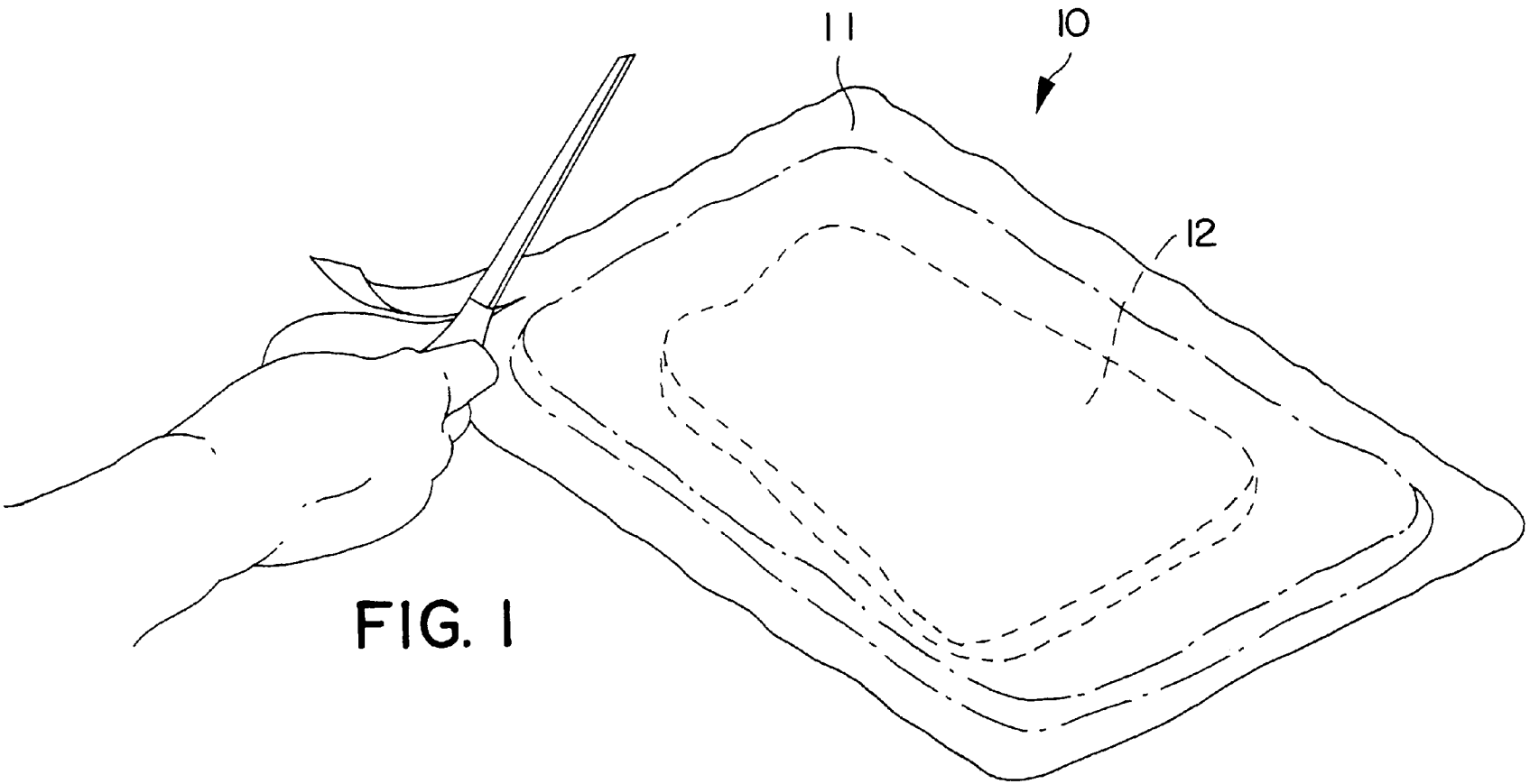
FIG. 1 is a perspective view of shin guard product according to an embodiment of the invention, being opened prior to removing the shin guard from its protective envelope.

Referring now specifically to the drawings, FIG. 1 illustrates an athletic body protective product 10 is shown according to an embodiment of the invention. The body protective product 10 includes as its outermost protective enclosure an outer moisture-impervious laminated foil pouch 11 in which the other components are sealed in the absence of moisture. The preferred structure of the outer moisture-impervious pouch 11 is preferably a 0.5 mil aluminum foil sheet sandwiched between two layers of low density polyethylene film, each layer having a thickness of 2 mils. Additionally, the pouch 11 can include an outer layer of laminated 60 gauge bi-axially oriented nylon film. This laminate structure, when properly formed into an envelope and sealed, will prevent moisture intrusion indefinitely. The pouch 11 contains protective guard according to the invention. For purposes of illustration in this application the body protective guard is a shin guard 12, as described below.

As shown in FIG. 1, the pouch 11 is opened with scissors, and removed from the pouch 11. The shin guard 12 is immediately dipped in water to initiate an exothermic curing reaction which hardens the shin guard 12 within several minutes.

Figure 3:
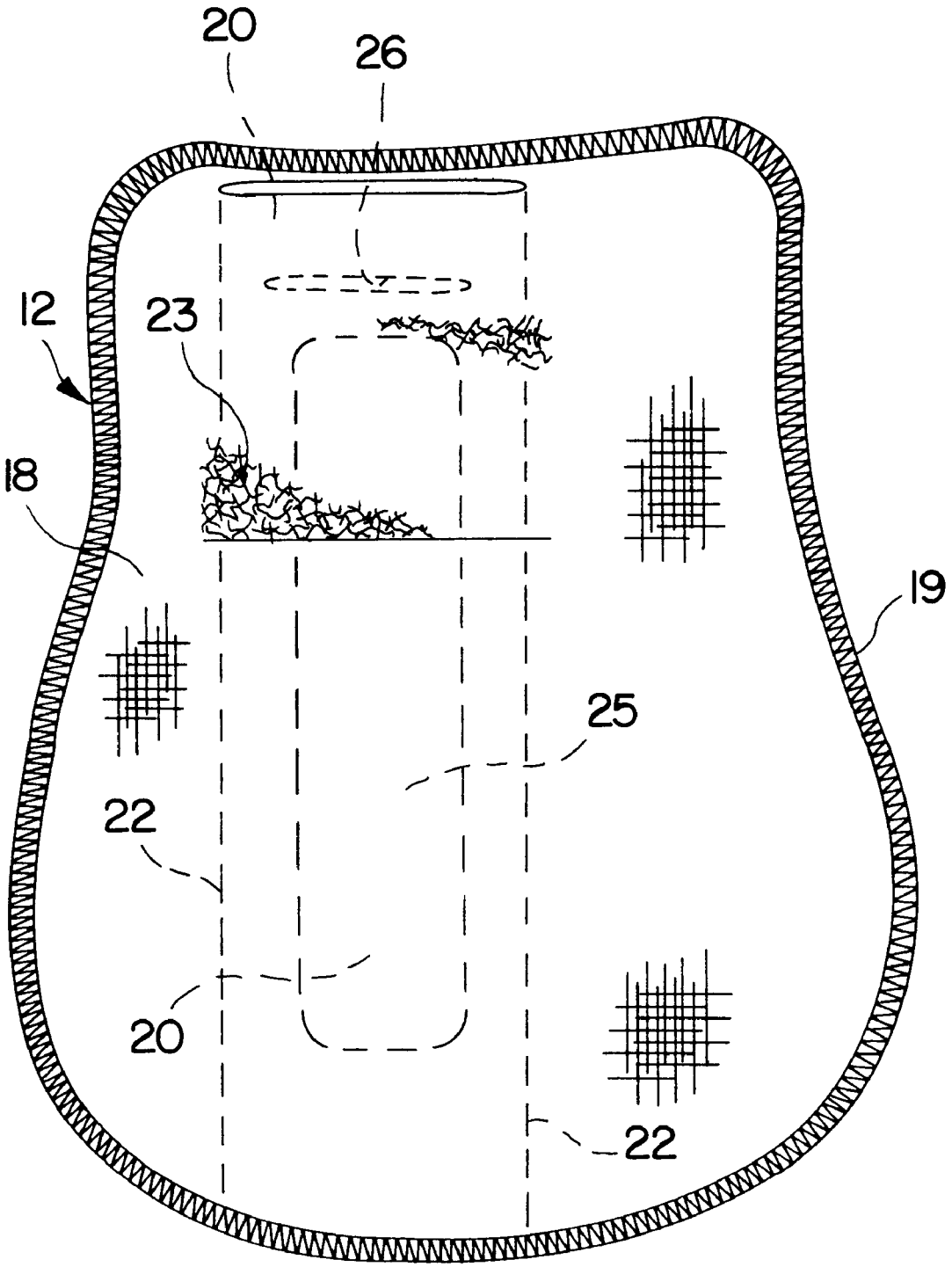
FIG. 3 is a plan view of one side of the shin guard.
Figure 4:
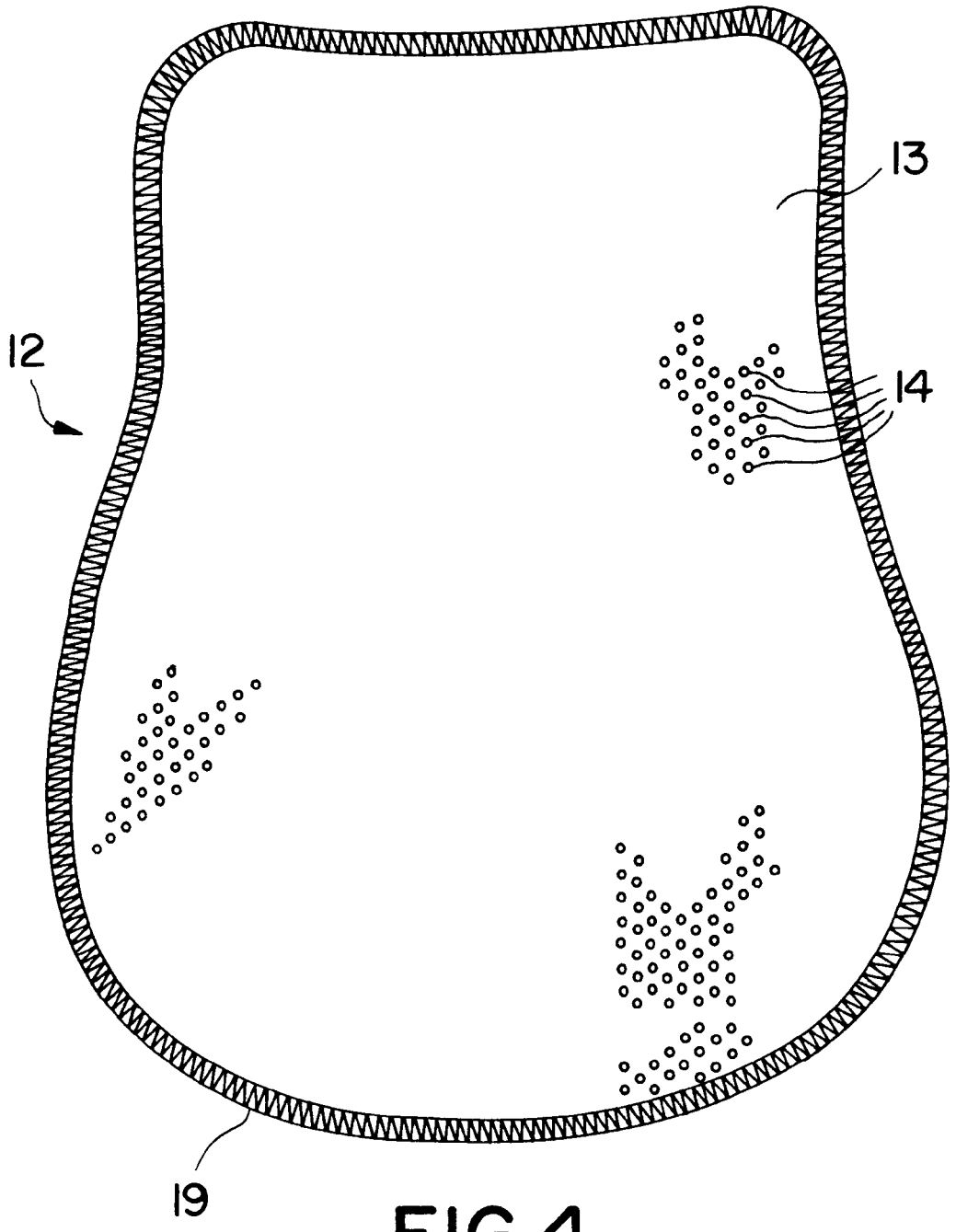
FIG. 4 is a plan view of the side of the shin guard opposite the side shown in FIG. 3.
Figure 5:
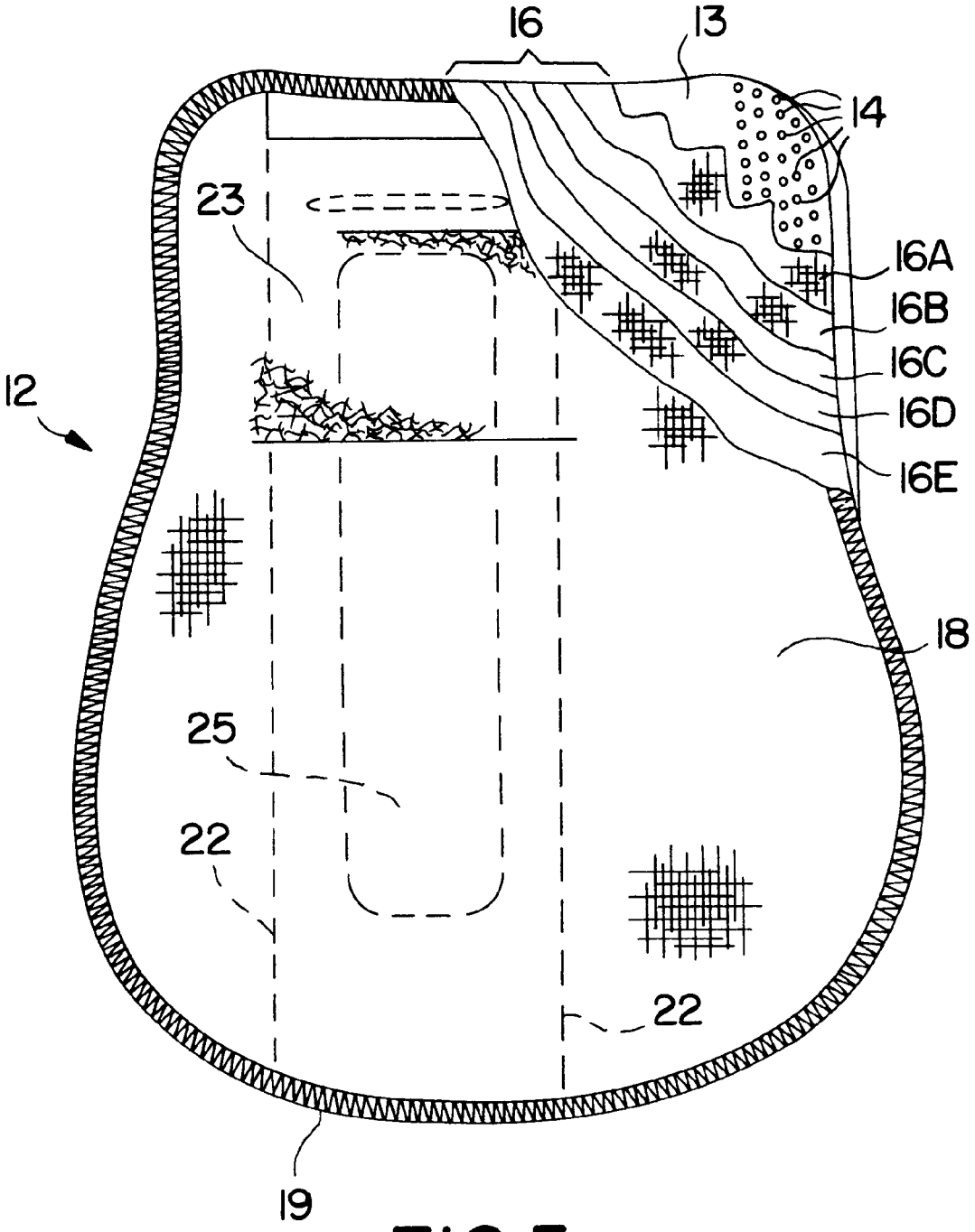
FIG. 5 is a fragmentary view with parts broken away of the shin guard shown in FIGS. 1–4.

The shin guard 12 is illustrated in further detail in FIGS. 3 through 5.

As is best shown in FIG. 5, shin guard 12 includes a protective pad 13 which is preferably a laminated one-eighth inch, four pound EVA (ethylene vinyl acetate) foam. Holes 14 may be provided for ventilation. The pad 13 provides a comfortable surface next to the skin, undersock or uniform, depending on use. The EVA foam is flexible enough to bend easily with the other components of the shin guard 12, particularly during fitting.

A substrate 16 overlies the pad 13. Substrate 16 is enclosed on the outwardly-facing side with a knitted or woven outer cover 18, such as a product known as Tietex. The pad 13, substrate 16 and outer cover 18 are formed into a unit by means of overedge or serging stitches 19 which extend around the perimeter of the shin guard 12.

Substrate 16 is preferably formed of fiberglass fabric layers 16A–16E which are impregnated or coated with a moisture-curable resin which hardens upon curing to form a rigid structure which retains the shape of shin to which it is molded while still flexible. The particular substrate 16 illustrated in this application contains five layers of fiberglass fabric 16A–16E, but many other variations are equally suitable, such as knitted or woven fabrics formed from other fibers, such as polyester or polypropylene.

The moisture-curable resin is a polyisocyanate as described in full in U.S. Pat. No. 4,770,299. This reactive system remains stable when maintained in substantially moisture-free conditions, such as in the moisture-impervious pouch 11, but hardens upon exposure to sufficient moisture to form a rigid, self-supporting structure. Set out below is a typical formulation suitable for practice of the present invention:

Typical Formulation:

| | | | |
|---|---|---|---|
| Isonate↓ 143L | or | | |
| Mondur↓ CD | or | polyisocyanate | 50.0% |
| Rubinate ↓ X1168 | | | |
| Pluracol↓ P1010 | | polyol | 46.6% |
| DC-200 Silicone | | defoaming agent | 0.30% |
| Benzoyl Chloride | | stabilizer | 0.10% |
| Thancat↓ DM-70 | | catalyst | 3.0% |
| | | | 100% |

A complete discussion of the parameters of the reactive system, the manner of production and the variables which apply are found in U.S. Pat. No. 4,411,262.

The polyisocyanate resin is characterized by being in a viscous, liquid unhardened state so long as the resin is not exposed to moisture. This permits the fiberglass layers 16A–16E and any flexible structure bonded to the layers to remain flexible and moldable so long as the resin is not exposed to moisture, and for a relatively short period of time after exposure to moisture. The curing time can be controlled to some extent by the quantity of water to which the resin is exposed. For example, exposure to water by dipping will result in quite rapid curing, while merely allowing the resin to be exposed to air will cause long curing times proportional to the amount of moisture, i.e., the humidity, in the air to which it is exposed.

Referring now specifically to FIG. 3, the shin guard 12 includes an elongate pocket 20 which is formed by sewing 22 stitches in two vertical, laterally spaced-apart rows onto the outer cover 18. The pocket 20 is defined within the space between the cover 18 and the underlying substrate layer 16E. The pocket 20 thus extends along the vertical extent of the shin guard 12 and receives a supplemental protective pad 25 through an insertion slit 26. As is shown in FIG. 3, the pocket 20 is offset slightly to one side of the vertical center-line of the shin guard 12, and thus is intended to lie directly over the crest of the tibia—the area slightly to the medial side of the lower leg which lies nearest the skin and is thus most susceptible to injury. The degree of offset may vary depending on the size of the shin guard and the width of the supplemental protective pad 25. However, an offset of 0.25–0.5 in. (6–12 mm) is generally sufficient.

Figure 11:
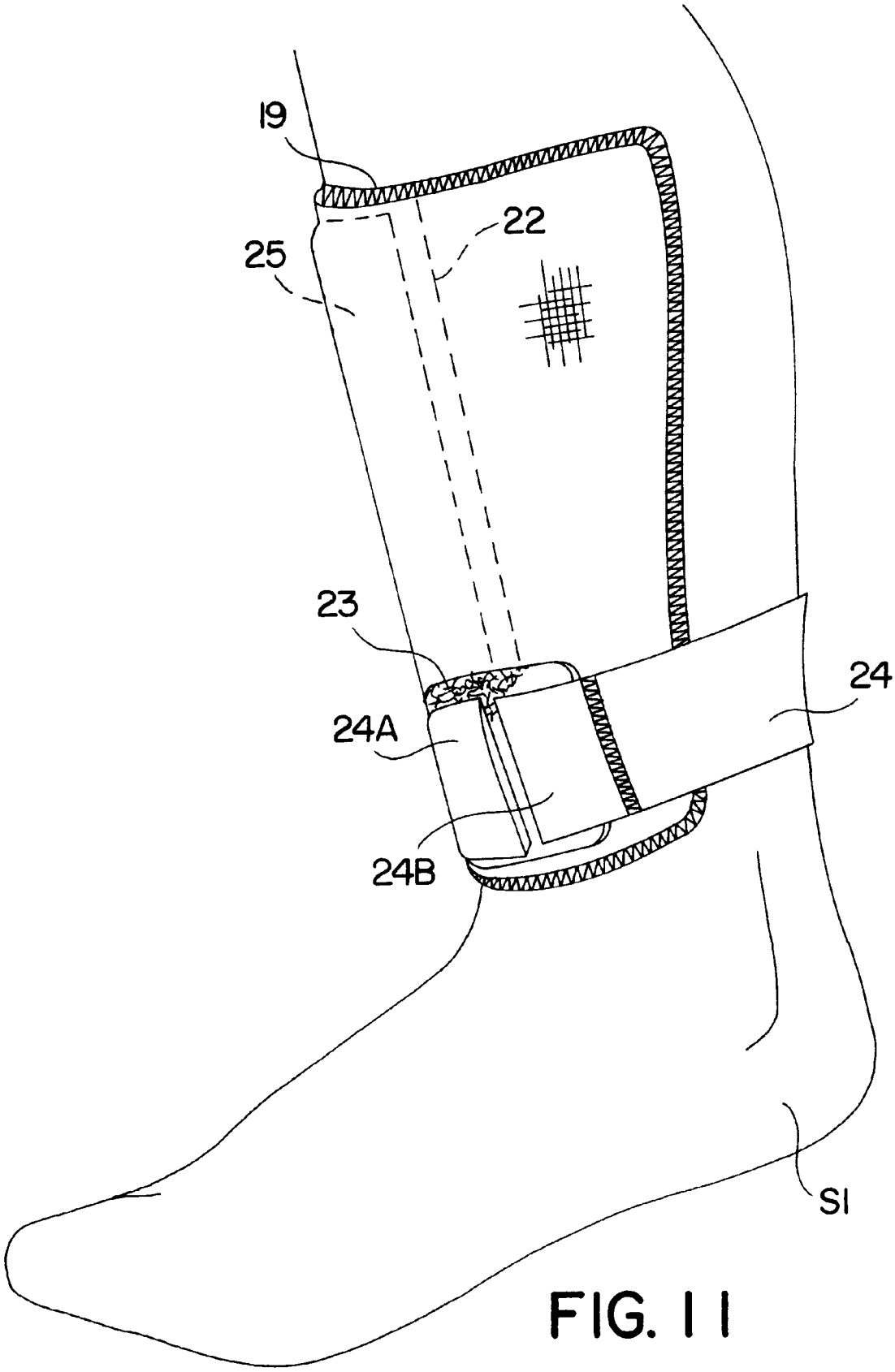
FIG. 11 shows the shin guard held in place by a strap.

A patch 23 of loop material is secured to the shin guard 12 as shown in FIG. 3 and is optionally available to secure the shin guard to the leg. This is accomplished by means of an elastic strap 24 having patches 24A, 24B of complementary hook material on opposite ends thereof which releasably attach to the loop material on the patch 23, as shown in FIG. 11. Other structures are also suitable, including elastic straps permanently attached on opposite side edges of the shin guard or straps permanently attached to one side edge and releasably attached to the other side edge by means of complementary hook and loop attachment members.

The patch 23 of loop material preferably overlies the insertion slit 26 and normally hides it from view. The patch 23 is preferably formed of an elasticized material, and is attached to the cover 18 on only three sides. The open side (nearest the slit 26) permits the elasticized patch 23 to be pulled upwardly away from the slit 26 are enough to insert the supplemental protective pad 25. After insertion, the patch 23 lies flush against the slit 26 and prevents the pad 25 from any tendency to exit the pocket 20 through the slit 26.

Figure 6:
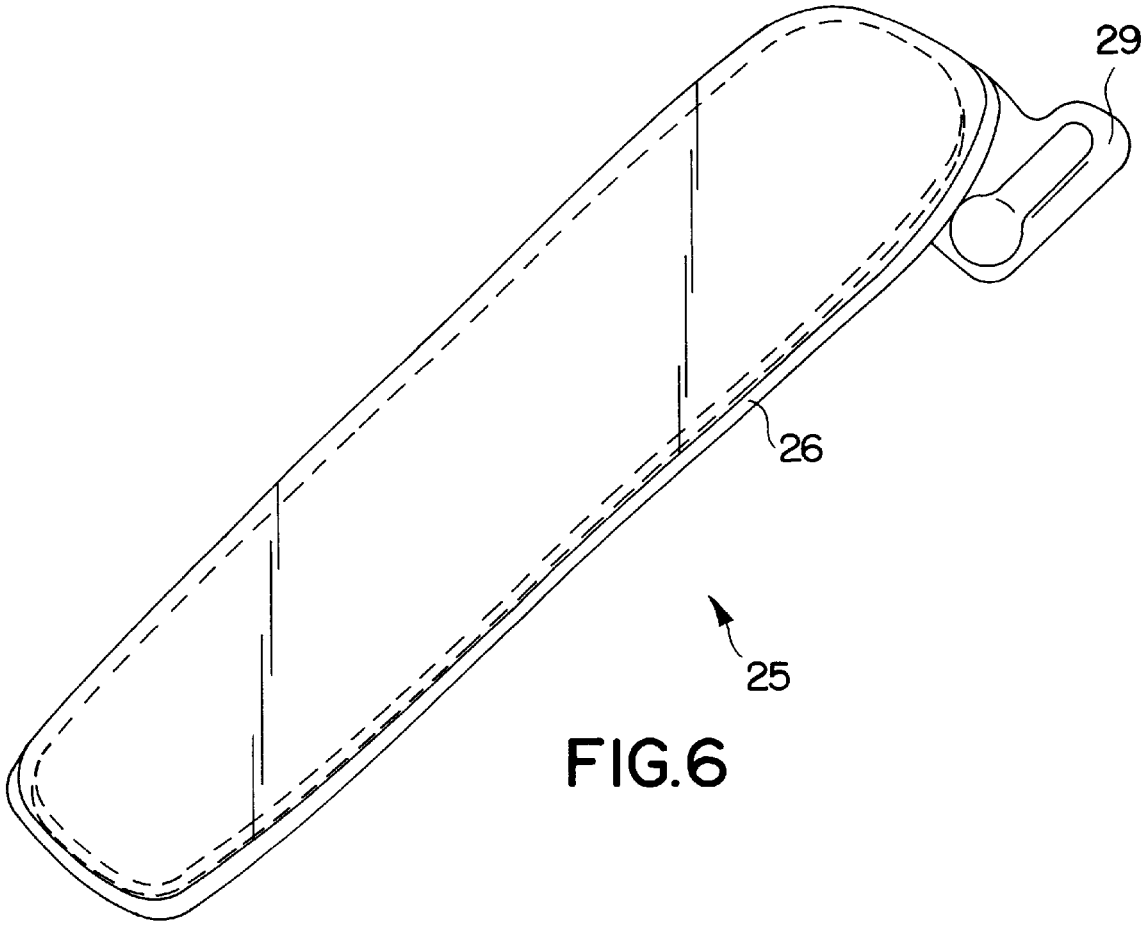
FIG. 6 is a perspective view of the supplemental pad of the guard according to an embodiment of the invention.
Figure 7:
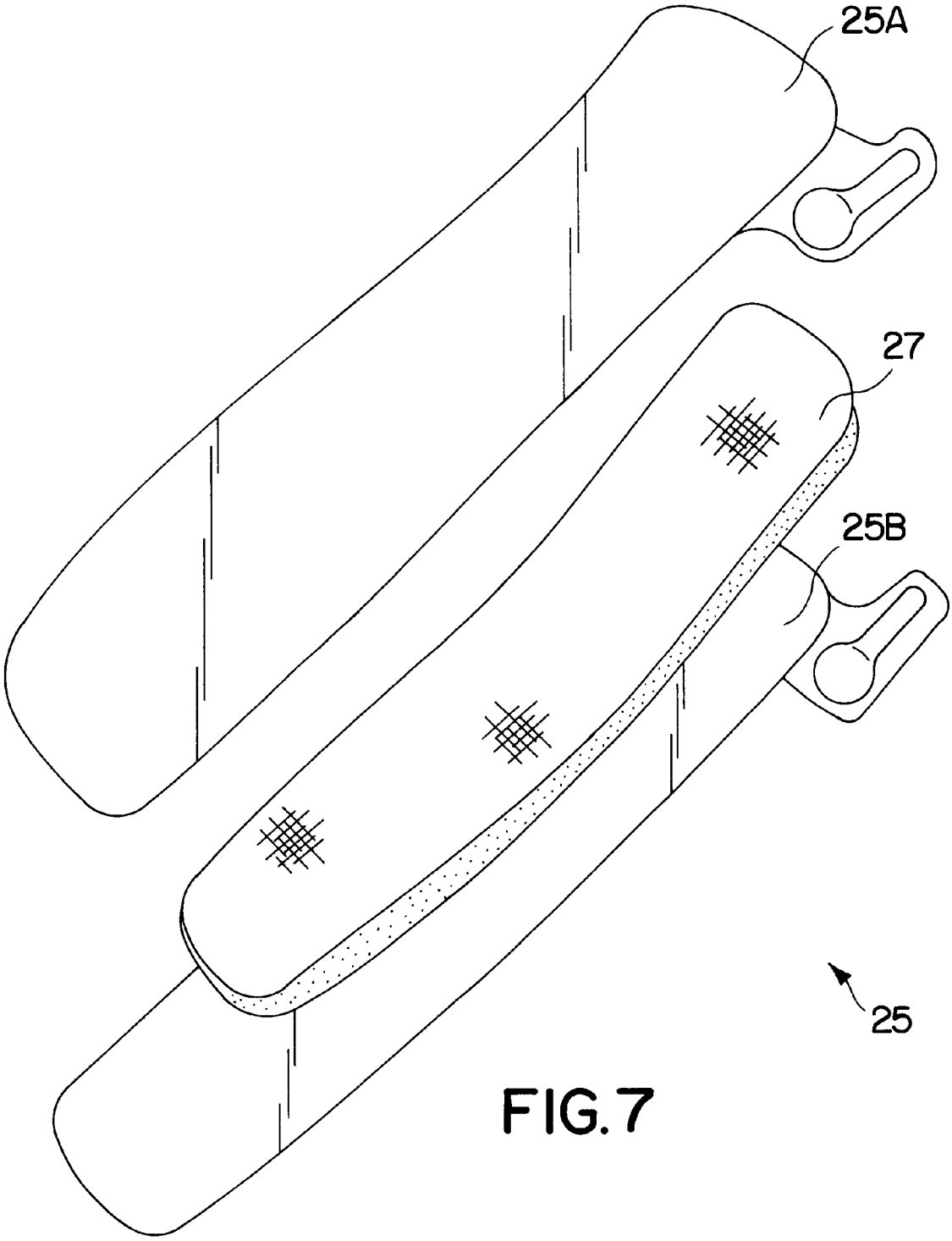
FIG. 7 is a fragmentary view with parts broken away of the supplemental pad shown in FIG. 6.

Referring now to FIGS. 6 and 7 the supplemental protective pad 25 is shown and illustrated. The pad 25 comprises an envelope formed of two mating sheets 25A, 25B of polyethylene plastic which is heat or ultrasonically-welded together about their common peripheries to define a joinder seam 26 (FIG. 6). The resulting structure must be capable of retaining a gas introduced therein under pressure.

A protective compressible member 27 is positioned within the pad before the sheets 25A, 25B are sealed together. The compressible member may be any suitable protective padding material, but a dense foam such as EVA has been found suitable. The foam may be covered with a protective fabric scrim or other material to aid in maintaining the integrity of the foam during use.

A gas injection port 29 serves as a means of pressurizing the interior of the protective pad 25. After assembly of the pad 25, a gas such as air is injected into the interior of the pad 25, and the injection port is sealed shut while the pressure is maintained in the pad 25. The result is a protective pad 25 which provides both pneumatic and mechanical cushioning protection to the shin bone by the gas-pressurized protective pad 25 and the compressible member 27, respectively.

Figure 2:
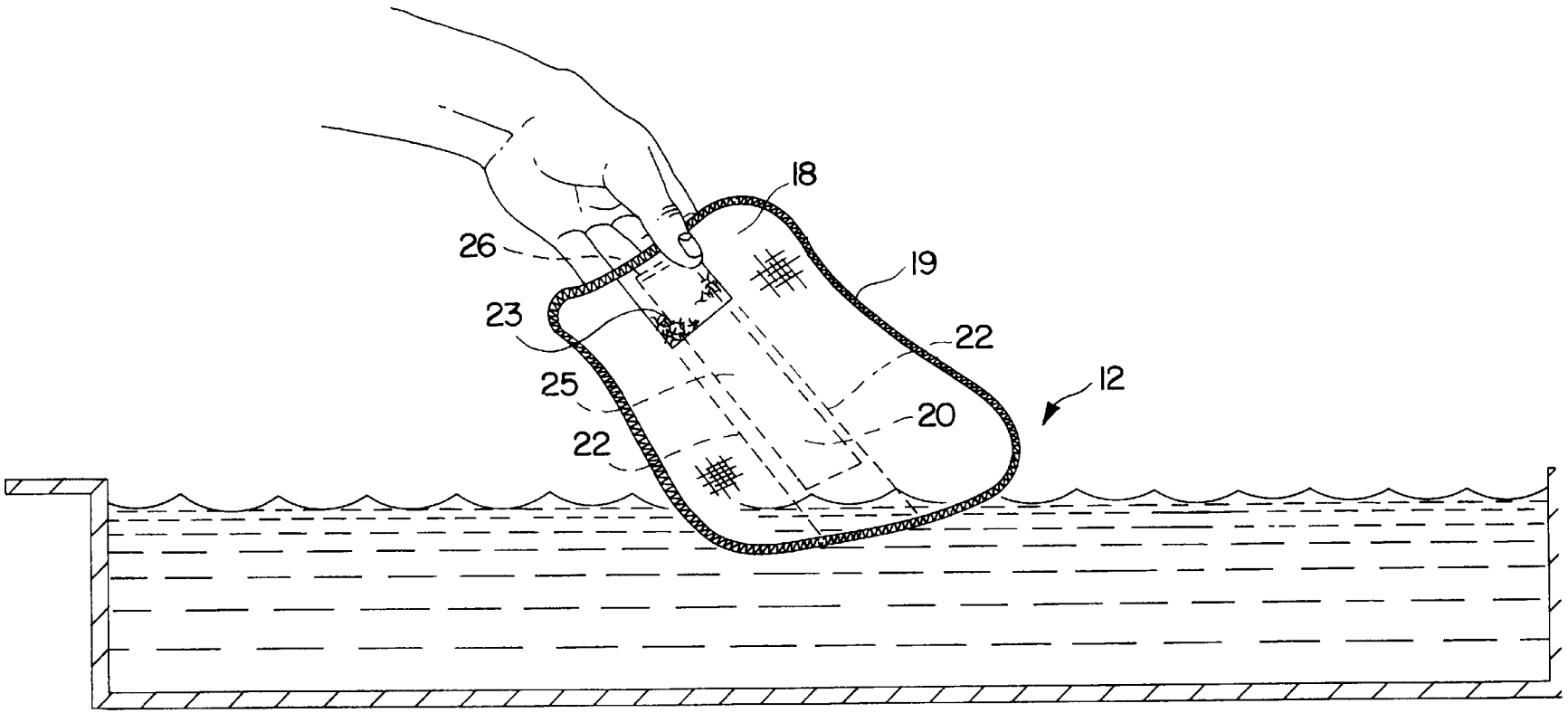
FIG. 2 is a perspective view of showing wetting of the shin guard prior to applying to the shin.
Figure 8:
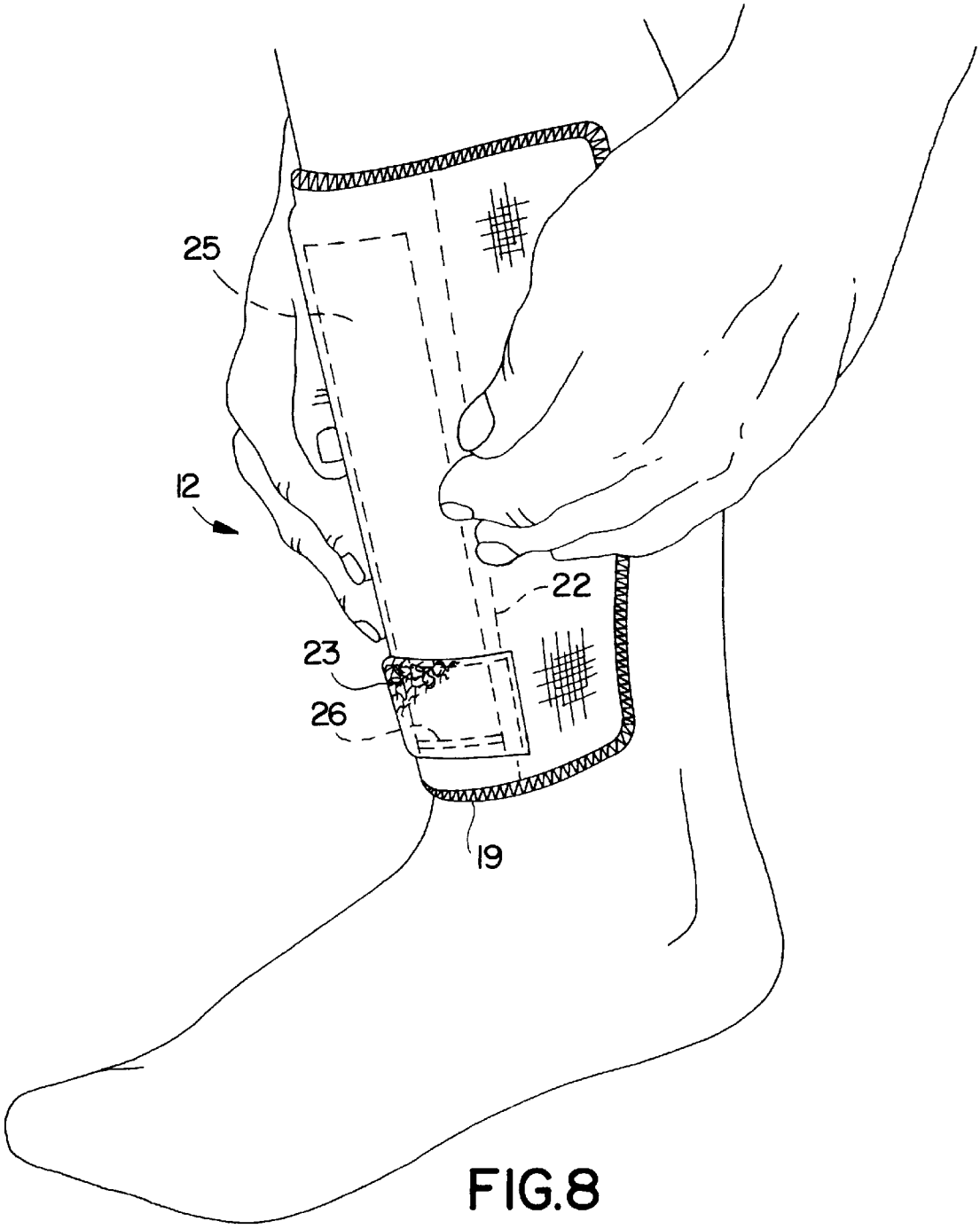
FIG. 8 shows the shin guard being formed to the shin.

Custom fitting of the body protective guard described above will now be explained with reference to FIGS. 8 through 11, with particular reference to the shin guard 12 illustrated and described above. As removed from the pouch 11, the shin guard 12 is soft and flexible. The shin guard 12 is then moistened, either by dipping in water as is shown in FIG. 2. While wet but still flexible, shin guard 12 is immediately applied to the shin, as shown in FIG. 8. Since curing of the resin in the substrate 16 begins immediately, the wearer must be available when the shin guard 12 is removed from the pouch 11. The pressurized protective pad 25 is inserted into the pocket 20 through slit 26.

Figure 9:
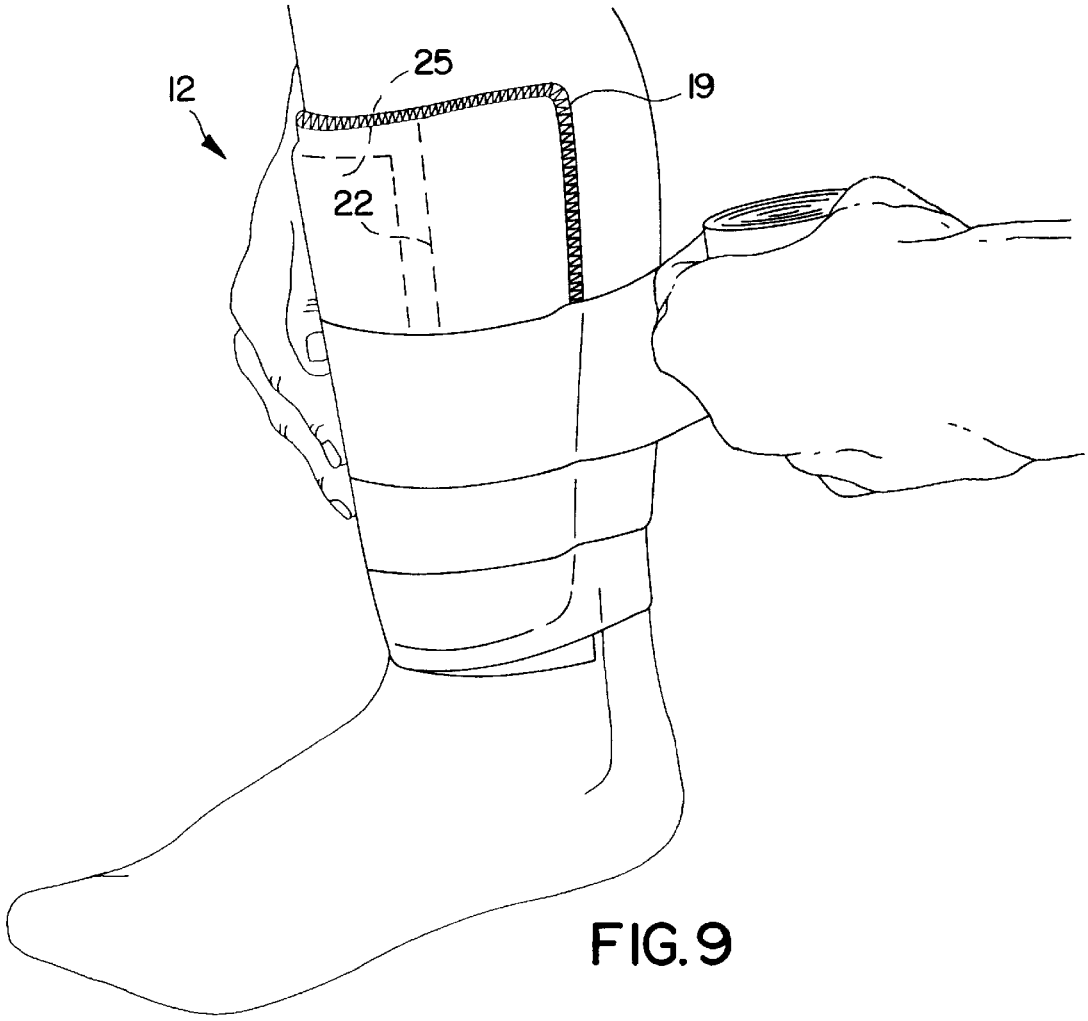
FIG. 9 shows the guard being wrapped to maintain its configuration against the shin until the guard is hardened into its final shape.

As is shown in FIG. 9, the shin guard 12 is then held firmly in position on the shin by overwrapping the shin guard 12 with an elastic bandage. Ordinarily, the resin will completely cure, and the shin guard will be permanently molded into the exact shape desired in ten minutes or less. Resins of the type used to produce the molded shin guard 12 as described above cure quickly and result in a very rigid and strong, but extremely lightweight structure. The rigidity and strength of the resulting structure provide excellent protection against injury, while protecting previous injuries or wounds from further impact-induced damage.

Figure 10:
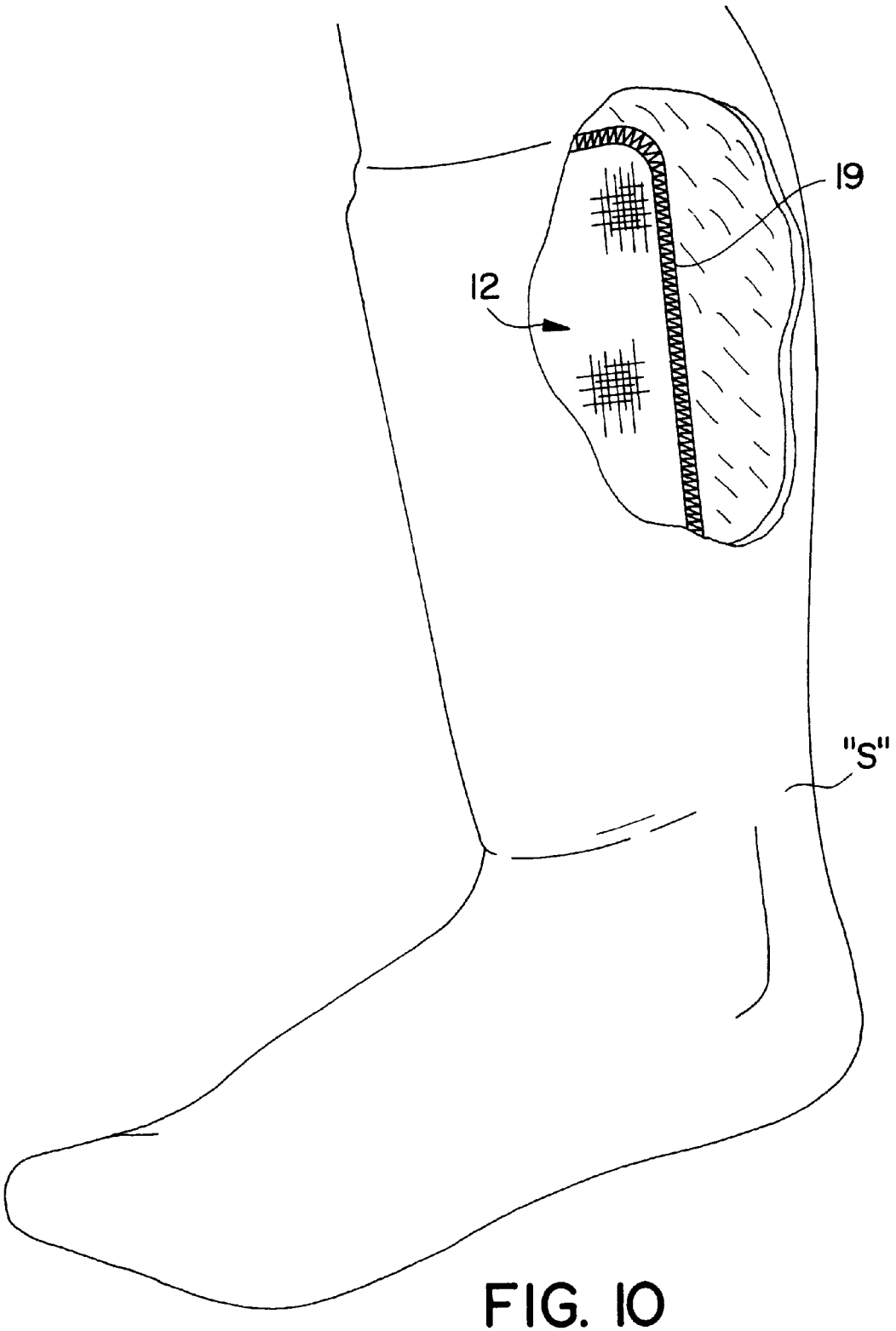
FIG. 10 shows the shin guard in place beneath a game sock.

As is shown in FIG. 10, the shin guard 12 can be worn directly next to the skin and under, for example, a soccer game sock "S". Since the shin guard 12 is molded directly next to the skin, the fit is virtually perfect, and fits so well that straps or belts may not be needed. The shin guard 12 can be held in place merely by the sock and the adherence of the shin guard 12 to the corresponding shape of the shin.

Alternatively, the shin guard 12 can be worn over an undersock "S1", as is shown in FIG. 11. Ordinarily, shin guard 12 will fit acceptably over the undersock "S1" even if molded directly over the skin. However, the shin guard 12 can be molded onto the shin while the wearer is wearing an undersock, if the shin guard 12 is to be normally worn over an undersock.

While the pressurized protective pad 25 is a suitable embodiment, other types of protective pads, including those constructed of dense foam or felt-like products may also be suitable, as may be pressurized pads which do not also contain padding along with the pressurized gas.

A protective pad for being molded onto a body part to be protected is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. An athletic body protective product with enhanced protection against direct impact to bone structure of the protected body part, (a) a storage package formed of moisture-impervious material and sealable to prevent entry of moisture;

(b) a flexible protective guard positioned in said storage package and sealed therein against entry of moisture, and for being custom-formed to the shape of a body part to be protected while flexible and upon hardening providing a rigid, supporting custom fit to the body part, said protective guard comprising:

(i) a substrate, including a reactive system impregnated into or coated onto said substrate, said system remaining stable when maintained in substantially moisture-free conditions and hardening upon exposure to sufficient moisture to form a rigid, self supporting structure;

(ii) a flexible protective pad positioned on one side of the substrate along its length to provide a cushioning barrier between the hardened substrate and the protected bone of the athlete when the protective guard is in use;

(iii) an elongate cover enclosing the substrate on a side of the substrate opposite the protective pad;

(iv) attachment means for attaching together said substrate, protective pad and cover to form a unitary structure; and (v) an elongate, narrow, supplemental bone protection pad positioned on an outer side of said substrate remote from said protective pad and residing in overlying relation to the bone to be protected thereby forming a multilayer protective structure comprising:

(a) the protective pad overlying the body part to be protected;

(b) the substrate overlying the protective pad; and (c) the supplemental bone protection pad overlying the substrate for providing supplemental protection against direct impact to the protected bone.

2. A body protective product according to claim 1, and including a pocket formed in vertically-extending orientation along the length of the guard for receiving and retaining said supplemental pad.

3. A body protective product according to claim 1, wherein the supplemental pad includes a flexible, resilient compressible member.

4. A body protective product according to claim 1, wherein the supplemental pad includes a flexible, resilient compressible member contained within a protective envelope.

5. A body protective product according to claim 1, wherein the supplemental pad comprises an elongate protective gas impermeable envelope, defining an interior containing a gas sealed therein under positive pressure to form a pneumatic cushion.

6. A body protective product according to claim 1, wherein the supplemental pad comprises:

(a) an elongate protective gas impermeable envelope defining an interior containing a gas sealed therein under positive pressure to form a pneumatic cushion; and (b) an elongate, flexible, resilient compressible member enclosed within said elongate protective gas impermeable envelope to provide a mechanical cushion, whereby the supplemental pad provides a combination of pneumatic and mechanical protection against direct impact to the protected bone.

7. A body protective product according to claim 1, wherein the supplemental pad is no more than one-third the width of the guard at the narrowest point along its length.

8. A body protective product according to claim 1, wherein said substrate comprises a plurality of overlaid fabric sheets.

9. A body protective product according to claim 1, wherein said substrate comprises a plurality of overlaid fiberglass sheets.

10. A shin guard product with enhanced tibial protection, comprising:

(a) a storage package formed of moisture-impervious material and sealable to prevent entry of moisture;

(b) a flexible shin guard positioned in said storage package and sealed therein against entry of moisture, and for being custom-formed to the shape of a shin while flexible and upon hardening providing a rigid, supporting custom fit to the shin, said shin guard comprising:

(i) a substrate, including a reactive system impregnated into or coated onto said substrate, said system remaining stable when maintained in substantially moisture-free conditions and hardening upon exposure to sufficient moisture to form a rigid, self supporting structure;

(ii) a flexible protective pad positioned on one side of the substrate along its length to provide a cushioning barrier between the hardened substrate and the shin of the athlete when the shin guard is in use;

(iii) an elongate cover enclosing the substrate on a side of the substrate opposite the protective pad;

(iv) attachment means for attaching together said substrate, protective pad and cover to form a unitary structure; and (v) an elongate, narrow, supplemental shin protection pad positioned in vertically-extending orientation along the length of the substrate, on an outer side of the substrate remote from the protective pad and residing in overlying relation to the shin bone of the wearer thereby forming a multilayer protective structure comprising:

(a) the protective pad overlying the body part to be protected;

(b) the substrate overlying the protective pad; and (c) the supplemental bone protection pad overlying the substrate for providing supplemental protection against direct impact to the shin bone portion of the lower leg.

11. A shin guard product according to claim 10, and including a pocket formed in vertically-extending orientation along the length of the shin guard for receiving and retaining said supplemental pad.

12. A shin guard product according to claim 10, wherein the supplemental pad includes a flexible, resilient compressible member.

13. A shin guard product according to claim 1, wherein the supplemental pad includes a flexible, resilient compressible member contained within a protective envelope.

14. A shin guard product according to claim 1, wherein the supplemental pad comprises an elongate protective gas impermeable envelope, defining an interior containing a gas sealed therein under positive pressure to form a pneumatic cushion.

15. A shin guard product according to claim 1, wherein the supplemental pad comprises:

(a) an elongate protective envelope, defining an interior containing a gas sealed therein under positive pressure to form a pneumatic cushion; and (b) an elongate, flexible, resilient compressible member enclosed within said elongate protective envelope to provide a mechanical cushion, whereby the supplemental pad provides a combination of pneumatic and mechanical protection against direct impact to the shin bone.

16. A shin guard product according to claim 1, wherein the supplemental pad is no more than one-third the width of said shin guard at its narrowest point along its length.

17. A shin guard product according to claim 16, wherein the supplemental pad is laterally offset with respect to a vertical centerline of the pad so as to reside directly over a crest of the tibia.

18. A shin guard product according to claim 15, wherein the resilient compressible member comprises a dense foam material.

* * * * *